US005759024A

United States Patent [19]

Robinson

[11] Patent Number: 5,759,024

[45] Date of Patent: Jun. 2, 1998

[54] FUEL VAPORIZER

[75] Inventor: Edgar C. Robinson, Vancouver, Canada

[73] Assignee: International Thermal Investments Ltd., Richmond, Canada

[21] Appl. No.: 555,849

[22] Filed: Nov. 13, 1995

Related U.S. Application Data

[63] Continuation of Ser. No. 163,905, Dec. 6, 1993, abandoned.

[30] Foreign Application Priority Data

Dec. 4, 1992 [CA] Canada ..... 2084560

[51] Int. Cl.[6] ..... F23D 11/44

[52] U.S. Cl. ..... 431/247; 431/207; 431/228

[58] Field of Search ..... 431/100, 103, 431/104, 105, 106, 107, 331, 333, 11, 247, 248, 222, 223, 227, 228, 229

[56] References Cited

U.S. PATENT DOCUMENTS

| | | | |
|---|---|---|---|
| Re. 28,679 | 1/1976 | Robinson . | |
| 131,951 | 10/1872 | Hayes | 431/247 |
| 360,558 | 4/1887 | Bussey | 431/218 |
| 492,718 | 2/1893 | Edwards . | |
| 617,687 | 1/1899 | Kitson . | |
| 714,947 | 12/1902 | Proskey . | |
| 747,434 | 12/1903 | Jaeger | 431/247 |
| 787,635 | 4/1905 | Phinney | 431/228 |
| 952,142 | 3/1910 | Rustige . | |
| 1,048,310 | 12/1912 | Hemphill et al. | 431/228 |
| 1,073,306 | 9/1913 | Tozer | 431/228 |
| 1,172,269 | 2/1916 | Forst | 431/228 |
| 1,187,589 | 6/1916 | Wiederhold . | |
| 1,577,773 | 3/1926 | Stroud | 431/228 |
| 1,618,392 | 2/1927 | Stroud | 431/227 |
| 1,652,803 | 12/1927 | Stroud | 431/228 |
| 1,799,725 | 4/1931 | Brown | 431/227 |
| 1,815,317 | 7/1931 | Klein | 431/227 |
| 3,577,730 | 5/1971 | Oliphant | 431/248 |
| 4,102,328 | 7/1978 | Robinson . | |
| 4,807,850 | 2/1989 | Robinson . | |
| 5,033,956 | 7/1991 | Nystrom . | |

FOREIGN PATENT DOCUMENTS

| | | | |
|---|---|---|---|
| 1304652 | 7/1992 | Canada . | |
| 1046262 | 12/1953 | France | 431/228 |
| 1409816 | 7/1988 | U.S.S.R. | 431/331 |

*Primary Examiner*—Carl D. Price
*Attorney, Agent, or Firm*—John R. Uren

[57] ABSTRACT

A temperature compensated fuel control valve or regulator has a temperature sensor which senses the temperature of fuel entering the regulator. The temperature sensor controls the area of an orifice through which the fuel must pass in order to enter the burner. When the fuel is at low temperature, its viscosity will be higher and more of the orifice area will be exposed to the fuel. When the fuel is at high temperature, it will flow more easily and less of the orifice will be exposed to the fuel thereby allowing less fuel to pass to the burner.

10 Claims, 3 Drawing Sheets

FUEL VAPORIZER

This application is a continuation of U.S. patent application Ser. No. 08/163,905, filed Dec. 6, 1993 abandoned.

This invention relates to a fuel regulator and fuel vaporizer and, more particularly, to a temperature compensated fuel regulator and improved vaporizer for regulating the amount of fuel which may be passed to a burner and for vaporizing the fuel in an improved manner when it arrives.

BACKGROUND OF THE INVENTION

It is convenient for flexibility purposes to utilise a fuel regulator which is adapted to regulate any of a plurality of fuels, for example gasoline, fuel oil, diesel fuel, kerosene and the like which each have a different viscosity. In the past, orifices of different sizes have been used to pass each of the fuels in order to compensate therefore.

However, the viscosity of the fuel will also depend on the temperature of the fuel. As the temperature increases, the viscosity decreases with the result that the fuel will flow more quickly and vice versa. The size of the orifice through which the particular fuel will pass, therefor, is an average value found by taking the viscosity of the particular fuel at a temperature which will ordinarily be most widely used when the burner is being used. If, however, the temperature changes such that the flow of the fuel also changes in a magnitude such that the burning of the fuel is affected, the orifice size would have to be changed to allow the proper quantity of fuel to pass under the particular temperature in order to realize the desired heating.

This is so since if the orifice size was not changed and if the temperature increased, it is possible for enough fuel to pass through the orifice such that the burner is flooded and shut down or which can create a fire hazard. If less fuel passes than necessary, the heat produced by the burner could be insufficient.

In another aspect of the invention, fuel vaporizers are known and generally utilize an uptube which allows the fuel to increase its temperature prior to vaporization. A downtube, commonly known as an "R-tube", is used to distribute the vaporized fuel on one side of the uptube.

The downtube on existing vaporizers, however, does not disperse the vapor evenly in the burner. The vaporized fuel emanating from the downtube creates uneven fuel flow with more vaporized fuel on one side of the uptube than on the other side. This results in uneven burning with flames higher on one side of the burner than the other. Therefore, the combustion is relatively inefficient.

SUMMARY OF THE INVENTION

According to one aspect of the invention, there is provided a temperature compensated fuel regulator comprising a first temperature sensor to sense the temperature of a first fuel at an inlet to said regulator, an orifice between said inlet and an outlet of said regulator to allow said fuel to move from said inlet to said outlet, said temperature sensor being adapted to enlarge or reduce the area of said orifice between said inlet and said outlet so as to allow variable flow of said fuel throughout the enlargement or contraction of said orifice.

According to a further aspect of the invention, there is provided an improved fuel vaporizer apparatus comprising a burner uptube for carrying and vaporizing fuel extending substantially vertically and being adapted to be centrally located within a burner, said burner uptube being open at the most vertical end, a cap centrally located over the open end of said burner uptube, a casing extending downwardly from said cap and an annulus defined by the outside of said burner uptube and the inside of said casing, said annulus being operable to carry fuel vapor received from said burner uptube downwardly and to disperse said fuel vapor around the circumference of said burner uptube.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
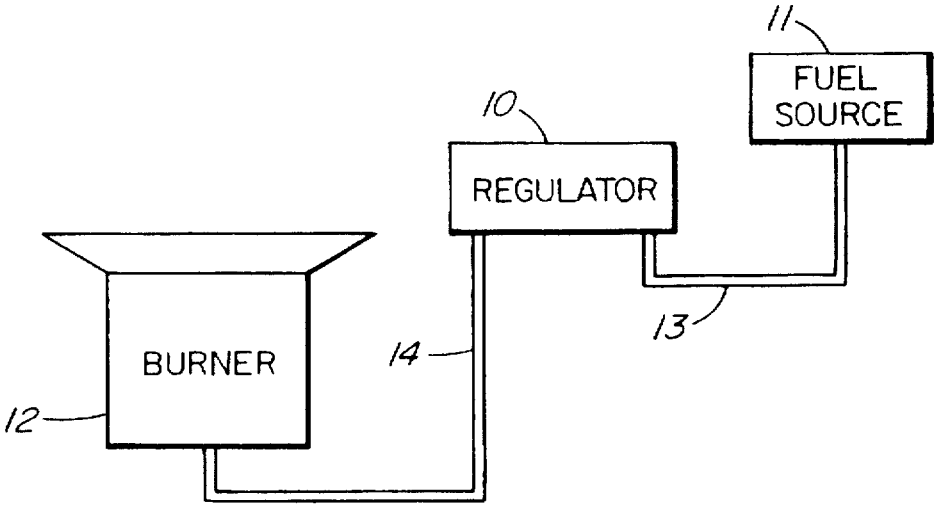
FIG. 1 is a diagrammatic block diagram of the fuel system comprising a burner being fueled by a temperature compensated fuel regulator which receives its fuel from a fuel source, all being in accordance with the invention.

Referring now to the drawings a temperature compensated fuel regulator is generally illustrated at 10 in FIG. 1. It is operably connected by a fuel line to a fuel source generally illustrated at 11 and to a burner generally illustrated at 12 downstream from the regulator 10.

Conveniently, the fuel source 11 will have the ability to utilise three or more fuels as desired by the operator, for example gasoline, diesel, jet fuel, kerosene and the like, although this is particularly attractive to the military for flexibility and is not a requirement for usual use outside the military. Likewise, the burner 12 desirably has the ability to burn any of the fuels although, again, this is not mandatory under non-military conditions.

Figure 2A:
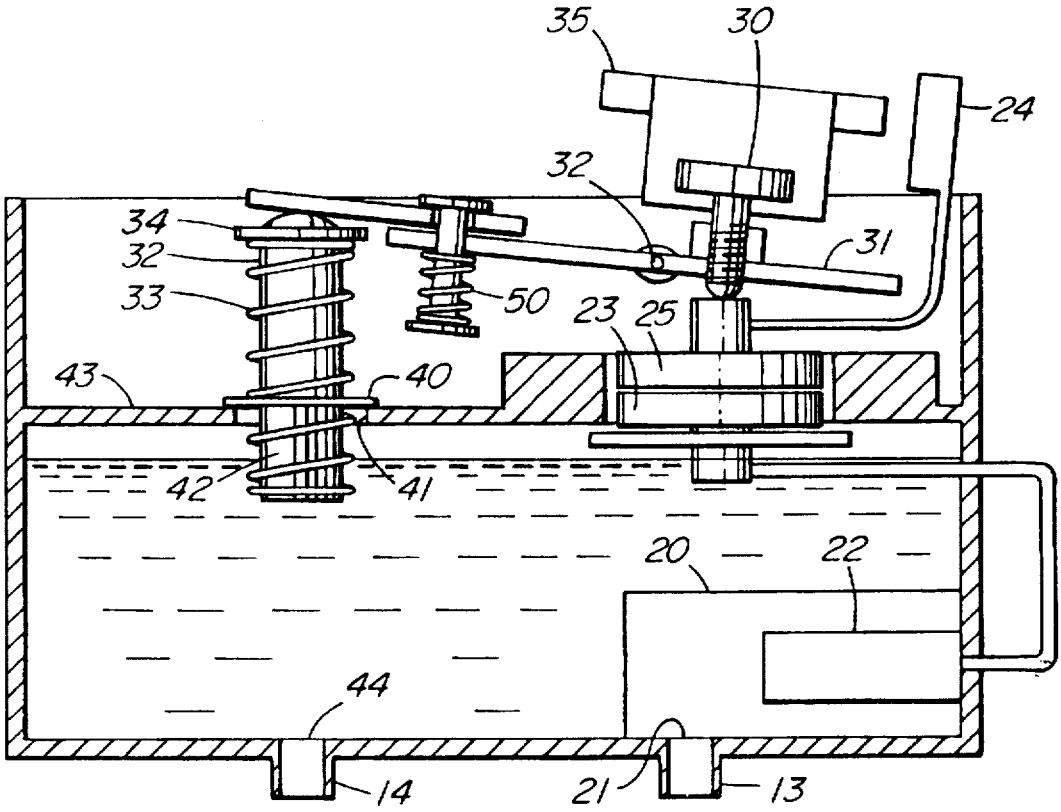
FIG. 2A is a diagrammatic partially cross-sectional side view of the fuel regulator according to the invention.

The regulator 10 is illustrated in greater detail in FIG. 2A. It comprises an inlet line 13 and an outlet line 14. A compartment 20 is formed immediately inside the inlet opening 21 of the regulator 10 and a first liquid filled temperature sensor 22 is located inside the first compartment 20 to sense the temperature of the oil within the compartment 20 and is connected to a diaphragm 25.

A second diaphragm 23 is provided. Diaphragm 23 is connected to a second temperature sensor 24 which conveniently may monitor either the temperature of the burner 12 in which event it is intended to shut down the fuel supply to the burner 12 when the burner 12 overheats or ambient conditions in which event it shuts off the burner 12 when the ambient temperature reaches its desired value. Diaphragm 23 may also be connected to a temperature sensor 22 which monitors the temperature of the incoming fuel. A manual adjustment screw 30 is provided, the screw 30 acting to rotate lever 31 about an axis 34 as will be described in greater detail hereafter.

A metering stem 32 is mounted within a spring 33 and a collar 34 extends around and is mounted to the fuel cylinder 32. A collar 40 extends across the opening 41. The spring 33 provides an outwards bias on the fuel cylinder 32 which tends to keep the contact portion 42 of the metering stem 32 in contact with the arm 42.

Figure 2B:
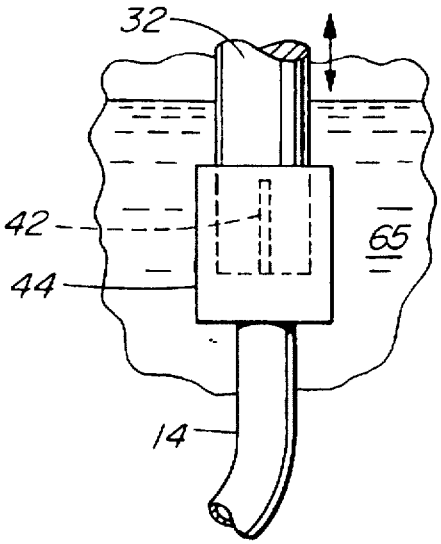
FIG. 2B is a diagrammatic enlarged view of the orifice in the fuel regulator.

The metering stem 32 also includes an orifice 42. The orifice is integral with the metering stem 32 and moves with the fuel cylinder 32 (FIG. 2B) as it moves relative to the housing 43 of the regulator 10. An outlet pipe 44 extends from the fuel cylinder 32 to the outlet line 44.

A compression spring 50 extends between the lever 31 and the ground in order to bias the lever 31 and the manual adjustment screw 30 against the diaphragm 23 about axis 34.

Figure 3:
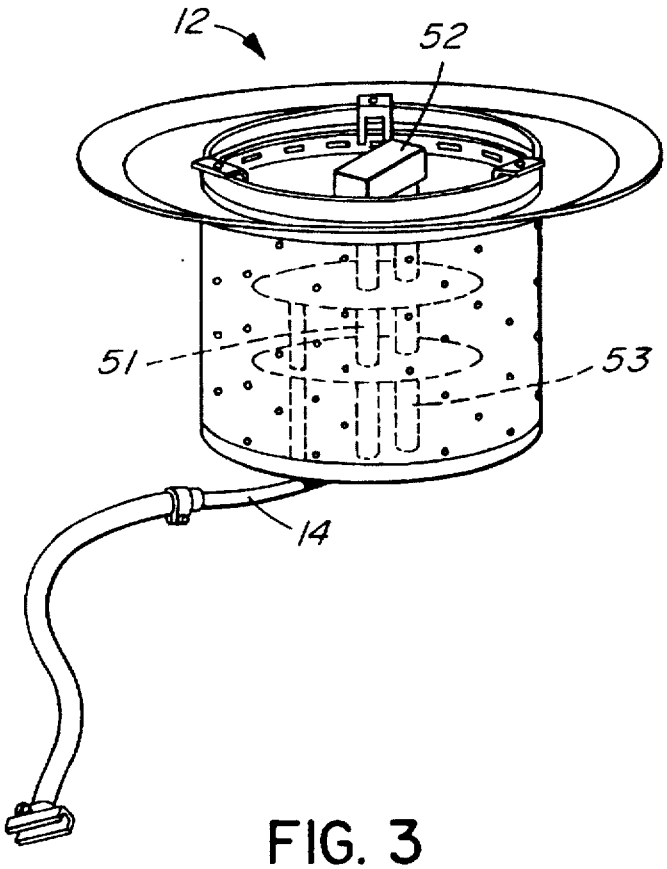
FIG. 3 is an isometric view of a burner as is known in the prior art.

The burner 12 is illustrated in greater detail in FIG. 3 and is the type used in the prior art. It comprises the fuel inlet tube 14 which extends from the regulator 10 to the burner uptube 51. A cap 52 is provided and a burner downtube 53 extends downwardly from the cap 52. As the fuel is vaporized in uptube 51, it passes into the cap 52 and thence to the downtube 53. The vapor is dispersed about the bottom of the burner 12 but principally on one side of the burner 12 and burner uptube 51.

Figure 4A:
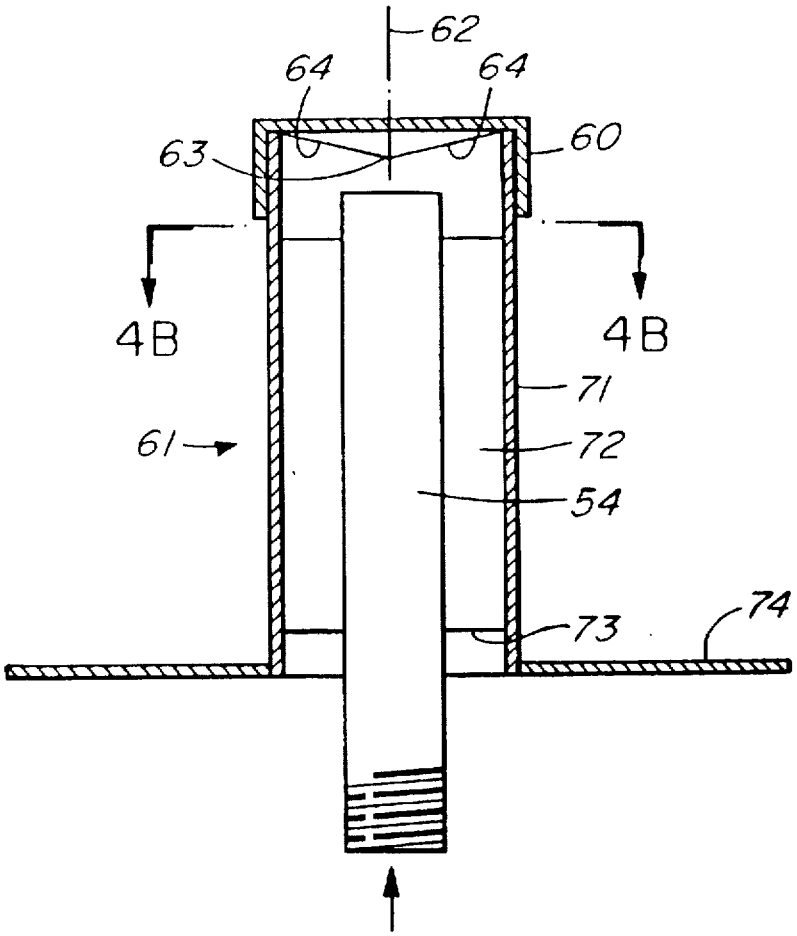
FIG. 4A is a diagrammatic and enlarged view of the vaporizer according to a further aspect of the invention.

Reference is now made to FIG. 4A where a vaporizer according to the invention is generally illustrated as 61. It comprises a burner uptube 54 and a burner cap 60 centrally located over the axis 62 of the burner tube 54. The burner cap 60 has an apex 63 with the surfaces 64 extending upwardly and outwardly from the apex in order to smoothly disperse the vapor from burner tube 54 about its circumference. An annulus 70 is provided between the burner tube 54 and the casing 71 of the vaporizer 61. Conveniently, a plurality of burner downtubes 72 (FIG. 4B) fill the annulus 70 and extend downwardly from the burner cap 60 to an end 73 which then disperses the vapor received from the burner uptube 54 and distributed to the burner downtubes 72 by the burner cap 60. A perforated or solid superheater 74 may be mounted about the burner casing 71 to enhance combustion efficiency by mixing the air with the fuel vapor.

OPERATION

In operation, it will be assumed that the fuel source 11 holds diesel fuel and that this diesel fuel is being passed to the regulator 10.

As the fuel leaves the inlet opening 21 from the fuel line 13, it enters compartment where the temperature of the incoming fuel is sensed by sensor 22. The sensor 22 will emit fluid to or take fluid from the diaphragm 23 and the diaphragm 23 will expand or contract depending on the temperature of the fuel in the compartment 20. If, for example, the temperature of the fuel is very low, the sensor will take fluid from the diaphragm 23 and the contraction of the diaphragm 23 will provide a downwardly directed force on the manual adjustment screw 30 which is threadedly mounted in lever 31 and the lever 31 will rotate clockwise about axis 34 under the influence of compression spring 33.

The clockwise rotation of the lever 31 will move the metering stem 32 upwardly in the fuel 51 and orifice 42 likewise moves with metering stem 32 relative to outlet pipe 44 (FIG. 2B) to expose more of the orifice 42 to the fuel 51 such that more fuel will pass through the orifice 42. The fuel will move downwardly within the metering stem 32, into the outlet pipe 44 and from the outlet pipe 44 into the outlet line 14 and thence to the burner 12.

As the fuel warms, the sensor 22 will signal the diaphragm 23 appropriately in order to reduce the size of the orifice 42 exposed to the fuel 51 and, thereby, to allow the appropriate reduced amount of fuel to pass through the orifice 42 to the burner 12.

A first manual adjustment screw 30 allows the system to be calibrated for certain temperature conditions. That is, the screw 30 will be adjusted such that the proper amount of fuel will be passed to the burner 12 under certain known temperatures. After the manual adjustment, the screw 30 will remain in such adjusted position relative to lever 31 and the diaphragm 23 will provide the only movement to lever 31 and metering stem 32. A second manual adjustment screw 35 may also be conveniently provided and will allow the orifice 42 to be of a size for a particular fuel.

A second temperature sensor 24 may also be provided as described. The sensor 24 is connected to the heater or burner 12 and is used to prevent overfueling. For example, in the event the temperature of the heater 12 increases beyond a predetermined set level, the temperature sensor 24 can act to reduce the fuel flow through the orifice 42 in order to remove the unsafe condition. Alternatively, it may monitor ambient conditions such that the burner 12 is shutdown when a desired temperature is reached. Of course, a temperature sensor could be used for both purposes simultaneously in addition to sensor 22.

While it is convenient to utilize a single orifice for multiple fuels, it may be the case that multiple orifices will be required so that different fuels can be used from the fuel source 11. It may well be the case that different fuels are desired to be used from the fuel source 11. In this event, it would be possible to utilize a plurality of orifices 42 in the metering stem 32 and to expose only that orifice 42 relating to the particular fuel to the fuel 51 in the regulator 10. The remaining orifices would be unused. The particular fuel being used would dictate the orifice and such orifice could be selected manually from a rotatable control for example.

As the fuel moves into the burner uptube 54 (FIG. 4A), it will be heated by the heat of the burner 12 and the fuel will vaporize in the burner uptube 54. As the fuel vaporizes, it will leave the burner uptube 54 at its open end and be smoothly dispersed about the apex 63 of the burner cap 60 to the downtubes 72 in the annulus 70. The vaporized fuel will be evenly dispersed from the downtubes 72 about the circumference of the burner uptube 54 and, accordingly, the flame in the burner 12 will be more even throughout the burner 12.

Figure 4B:
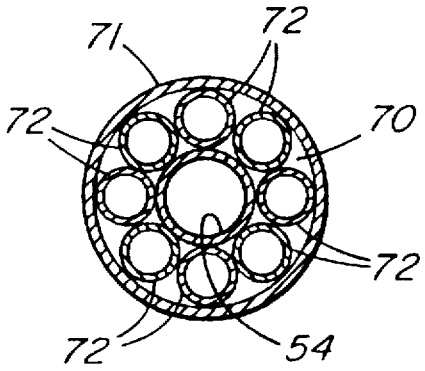
FIG. 4B is a diagrammatic view taken along IVB—IVB of FIG. 4A.
Figure 4C:
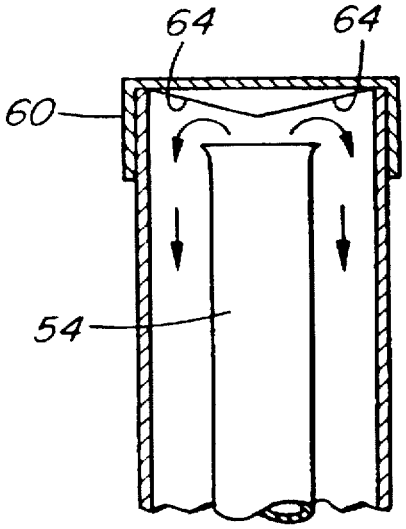
FIG. 4C, appearing with FIG. 2B is an enlarged partial side view of the vaporizer of FIG. 4A in a different embodiment.

While it is contemplated that downtubes 72 will fill the annulus 70 as illustrated in FIG. 4B, it is also contemplated that an open annulus would be of benefit, the objective being to evenly disperse the fuel vapor about the burner uptube 54 in order to provide more uniform combustion in the burner 12.

While a specific embodiment of the invention has been described, such description is illustrative of the invention only and should not be taken as limiting its scope as defined in accordance with the accompanying claims.

What is claimed is:

1. An improved fuel vaporizer apparatus comprising a burner uptube for carrying liquid fuel and vaporizing said liquid fuel, said burner uptube extending substantially vertically and having a longitudinal distance defined by a first open upward end and a second end opposed from said first open upward end, said burner uptube being adapted to be centrally located within a burner, said liquid fuel being vaporized between said first open upward end of said burner uptube and said second end opposed from said first open upward end, said burner uptube having an outer circumference, a cap centrally located over said first open upward end of said burner uptube, a casing having a longitudinal axis and an inside circumference, said casing having a first end adjacent said cap and a second end opposed from said first end, said casing extending downwardly from said cap around said burner uptube for a substantial portion of said longitudinal distance of said burner uptube and an annulus defined by said outside circumference of said burner uptube and said inside circumference of said casing, said annulus extending over a substantial portion of said longitudinal distance of said burner uptube, said annulus communicating with said first upward open end of said burner uptube, and being operable to carry fuel vapour received from said burner uptube downwardly and to disperse said fuel vapour around and in contact with said outside circumference of said burner uptube, said burner uptube being uninsulated in the area of said annulus, said annulus including a plurality of tubes extending downwardly from said cap and having axes parallel to the axis of said burner uptube.

2. A vaporizer as in claim 1 wherein said cap has an inside profile which is defined by an apex situated directly above said axis of said burner uptube, said apex smoothly blending into outwardly and upwardly extending surfaces adapted to receive vapor dispersed from said uptube and to disperse said vapor evenly about said uptube.

3. A vaporizer as in claim 2 wherein said apex on the inside profile of said cap flares into said outwardly and upwardly extending surfaces.

4. A vaporizer as in claim 1 wherein the open end of said burner uptube is flared outwardly.

5. A vaporizer as in claim 4 and further including a member surrounding said casing adjacent said second end of said casing opposed from said first end of said casing adjacent said cap, said member extending normally outwardly from said longitudinal axis of said casing.

6. A vaporizer as in claim 4 and further including a solid superheater-surrounding said burner casing.

7. An improved fuel vaporizer apparatus comprising a burner uptube having a longitudinal axis for carrying liquid fuel and vaporizing said liquid fuel, said burner uptube extending substantially vertically and having a first open upward end and a second end opposed from said first open upward end, said burner uptube being adapted to be centrally located within a burner, said liquid fuel being vaporized between said first open upward end of said burner uptube and said second end opposed from said first open upward end, said burner uptube having an outside circumference, a cap centrally located over said first open upward end of said burner uptube, a casing having a longitudinal axis and an inside circumference, said casing having a first end adjacent said cap and a second end opposed from said first end, said casing extending downwardly from said cap, an annulus defined by said outside circumference of said burner uptube and said inside circumference of said casing, said annulus communicating with said first upward open end of said burner uptube and being operable to carry fuel vapour received from said burner uptube downwardly and to disperse said fuel vapour around the circumference of said burner uptube, said annulus further carrying a plurality of tubes extending downwardly from said cap, said tubes being generally parallel to said burner uptube and carrying said fuel vapour downwardly within said annulus.

8. A vaporizer as in claim 7 and further including a member surrounding said casing adjacent said second end of said casing opposed from said first end of said casing adjacent said cap, said member extending normally outwardly from said longitudinal axis of said casing.

9. A vaporizer as in claim 8 wherein said member is perforated.

10. A vaporizer as in claim 8 wherein said member is solid.

* * * * *